US008232728B2

(12) United States Patent
Krohmann et al.

(10) Patent No.: US 8,232,728 B2
(45) Date of Patent: Jul. 31, 2012

(54) METHOD AND DEVICE FOR IGNITING AND GENERATING AN EXPANDING DIFFUSE MICROWAVE PLASMA AND METHOD AND DEVICE FOR PLASMA TREATING SURFACES AND SUBSTANCES BY USING THIS PLASMA

(75) Inventors: Udo Krohmann, Neubrandenburg (DE); Torsten Neumann, Neubrandenburg (DE); Joerg Ehlbeck, Hinrichshagen (DE); Kristian Rackow, Greifswald (DE)

(73) Assignee: INP Institut Fuer Niedertemperatur-Plasmaphysik e.V., Greifswald (DE)

( * ) Notice: Subject to any disclaimer, the term of this patent is extended or adjusted under 35 U.S.C. 154(b) by 784 days.

(21) Appl. No.: 11/991,493

(22) PCT Filed: Sep. 7, 2006

(86) PCT No.: PCT/EP2006/066100

§ 371 (c)(1),
(2), (4) Date: Feb. 5, 2009

(87) PCT Pub. No.: WO2007/028813

PCT Pub. Date: Mar. 15, 2007

(65) Prior Publication Data

US 2010/0001647 A1 Jan. 7, 2010

(30) Foreign Application Priority Data

Sep. 9, 2005 (DE) ..... 10 2005 043 278
Sep. 24, 2005 (DE) ..... 10 2005 045 825

(51) Int. Cl.
*H01J 7/24* (2006.01)

(52) U.S. Cl. ..... 315/111.21; 315/111.41; 315/111.91

(58) Field of Classification Search ..... 315/500, 315/501, 506, 507, 111.21, 111.41, 111.71, 315/111.91
See application file for complete search history.

(56) References Cited

U.S. PATENT DOCUMENTS 4,745,337 A 5/1988 Pichot et al.
(Continued)

FOREIGN PATENT DOCUMENTS

DE 42 35 914 4/1994
(Continued)

*Primary Examiner* — Douglas W Owens
*Assistant Examiner* — Jianzi Chen
(74) *Attorney, Agent, or Firm* — Jordan and Hamburg LLP

(57) ABSTRACT

The invention relates to a method for igniting and generating an expanding diffuse microwave plasma and to a device for carrying out such a method. The method is particularly suited for generating microwave plasmas for the purpose of carrying out plasma treatment of surfaces and substances, particularly three-dimensional objects as well as particles under atmospheric pressure. The aim of the invention is to provide a method for igniting and generating these plasmas that is, particularly under normal and high pressure, easy and operationally safe as well as, in principle, carried out without a flow of gas. The invention also relates to a method and device for carrying out plasma treatment of surfaces and substances by means of such a plasma, which makes an effective plasma treatment possible due to its high stability with regard to plasma generation and maintenance, low gas consumption and a high plasma volume. To this end, a plasma ignition ensues inside a wave-bound hollow structure by means of microwave launching over a resonant igniting structure, a simultaneous impelling of the plasma through the resonant igniting structure, however, is not possible. The ignited plasma is supplied with energy via a surrounding microwave field so that an expanding diffuse plasma forms. A particular embodiment in a coaxial arrangement makes it possible to generate a plasma exiting the device for the purpose of carrying out mobile plasma treatment.

15 Claims, 3 Drawing Sheets

Resonant ignition structure in the inner conductor

Resonant ignition structure in the outer conductor

U.S. PATENT DOCUMENTS

| | | | | |
|---|---|---|---|---|
| 5,401,351 | A | | 3/1995 | Samukawa |
| 5,517,085 | A | | 5/1996 | Engemann et al. |
| 5,767,627 | A | * | 6/1998 | Siniaguine ..... 315/111.41 |
| 5,798,146 | A | | 8/1998 | Murokh et al. |
| 5,961,772 | A | | 10/1999 | Selwyn |
| 6,043,608 | A | | 3/2000 | Samukawa et al. |
| 6,543,380 | B1 | | 4/2003 | Sung-Spitzl |
| 6,645,343 | B1 | | 11/2003 | Wild et al. |
| 6,841,201 | B2 | | 1/2005 | Shanov et al. |

FOREIGN PATENT DOCUMENTS

| | | |
|---|---|---|
| DE | 196 05 518 | 8/1997 |
| DE | 197 26 663 | 1/1999 |
| EP | 0 420 101 | 4/1991 |
| EP | 0 209 469 | 1/1997 |
| EP | 0 968 524 | 1/2000 |
| WO | WO-03/096766 | 11/2003 |

* cited by examiner

METHOD AND DEVICE FOR IGNITING AND GENERATING AN EXPANDING DIFFUSE MICROWAVE PLASMA AND METHOD AND DEVICE FOR PLASMA TREATING SURFACES AND SUBSTANCES BY USING THIS PLASMA

BACKGROUND OF THE INVENTION

The present invention relates to a method for igniting and generating an expanding, diffuse microwave plasma. The invention furthermore relates to a device for performing such a method. The method is suitable for generating microwave plasmas for the purpose of plasma-treating surfaces and substances, in particular three-dimensional objects and also particles under atmospheric pressure.

Microwave plasmas are well suited for performing various plasma treatments, such as e.g. activation, cleaning, coating, sterilization, modification, and functionalization of surfaces. The use of a diffuse, largely homogeneous, expanded plasmas is desired for this.

In known methods (DE 4235914 A1, EP0209469, DE19726663), such plasmas are preferably ignited and generated in the low pressure range or near atmospheric range. Although it is possible raise it and use it in the normal pressure range, this renders the plasma treatment process very sensitive and unstable. Minor changes (e.g. from gas flow, mixing in process gases, and mixing in aerosols and particles) causes the plasma to extinguish, and it must be re-ignited, which is very complex.

Other known methods for plasma treatment under atmospheric pressure, such as barrier discharge, are not suitable for treating three-dimensional objects and highly structured surfaces.

Various embodiments of plasma jets (DE19605518, EP0968524, U.S. Pat. No. 5,798,146) require a high gas flow, generally a special working gas, for driving out the plasma, and are problematic in terms of ignition behavior. Moreover, they generate only a small volume of plasma having a small diameter. Thus they are not suitable for large-scale applications and are expensive in terms of production and operation.

Thus a method for igniting and generating a spatially expanded plasma in normal pressure or high pressure and having high ignition certainty, stable operation, and the lowest possible gas throughput would be advantageous.

Wider and more cost-effective use of the plasma treatment is not possible in many fields unless complex vacuum technology is not needed, working gases and process gases are used less, and handling is simple and safe.

SUMMARY OF THE INVENTION

The underlying object of the present invention is therefore to provide a method for igniting and generating a diffuse, spatially expanded microwave plasma, which method can be realized simply and in an operationally safe manner, in particular in normal pressure and high pressure, and can furthermore be realized in principle without a gas flow.

In addition, the object of the invention is to provide a method and a device for plasma-treatment of surfaces and substances by means of expanding, diffuse microwave plasma under atmospheric pressure, which method makes possible effective plasma treatment due to its great stability in terms of plasma generation and maintenance, low gas consumption, and great plasma volume.

The method for igniting and generating an expanding, diffuse microwave plasma is characterized in that:

a) at least one resonant ignition structure is arranged within a wave-limiting hollow structure;

b) plasma ignition by microwave injection is initiated in that the resonant ignition structure is dimensioned and arranged such that power is injected into the resonant ignition structure and a high resonance field strength for the plasma ignition is attained locally, while simultaneous driving of the plasma through the resonant ignition structure is not possible and thus there is inherent protection of the ignition device (an autocontrolling transition between plasma ignition phase and plasma maintenance phase);

c) the plasma ignited by the resonant ignition structure is fed with energy via a surrounding microwave field such that an expanding, diffuse plasma results;

d) this feeding into the resonant ignition structure and into the plasma occurs via the same microwave field.

This method can be used both at low pressure and at atmospheric pressure and thereabove.

Applying a gas flow makes it possible to drive the plasma, which can cause the plasma volume to increase corresponding to the injected power.

The method can be realized with desired gases and mixtures thereof with and without gas flow.

Depending on the embodiment, the resonant ignition structure can be supplied with microwave energy via direct injection or from a surrounding free microwave field.

The generation of an expanding, diffuse plasma within a coaxial hollow structure represents one particularly interesting embodiment of the invention. At its end the center conductor is embodied as a resonant ignition structure such that injection of microwaves leads to ignition of the plasma, but the plasma supplies itself with energy via the coaxial line. The diameter of the coaxial outer conductor should be selected such that, corresponding to the frequency used when the outer conductor is continued out via the end of the center conductor, wave propagation via the open end of the outer conductor is not possible but the plasma exits from the opening.

If the resonant ignition structure is arranged in the vicinity of a field maximum of a microwave field such that the forming plasma grows into the field maximum, the plasma will separate from the ignition structure.

In an arrangement of the resonant ignition structure at one end of a waveguide and with the microwaves fed: from the other end, after the plasma forms the resonant ignition structure is largely decoupled from the microwave supply. This protects the ignition structure from the effects of the plasma.

Microwave frequencies ranging from 400 to 10,000 MHz are suitable for generating the plasma.

The properties of the plasma (e.g. temperature, expansion) can be influenced by pulsing and modulating the energy feed.

A specific arrangement of the resonant ignition structure within the wave-limiting hollow structure and a corresponding opening makes it possible for the plasma to exit from the wave-limiting hollow structure.

Another particularly advantageous embodiment of the resonant ignition structure is characterized in that it is arranged in the center conductor or in the outer conductor of the coaxial line and in that it is embodied itself as a coaxial structure having a resonant length of $\lambda/4$ (Lambda/4) (quarter wavelength) or an uneven multiple of $\lambda/4$ (Lambda/4) corresponding to the frequency used.

The method for surface treatment by means of an expanding, diffuse microwave plasma is characterized in that within a coaxial hollow structure an expanding, diffuse microwave plasma that is exiting from the structure is ignited, suitable substances are supplied to the plasma for a plasma treatment, and surfaces and substances to be treated are conveyed to the effective range of the plasma.

The substances provided for the plasma treatment can be supplied to the plasma in solid (powder), liquid, or gas form.

Modulation and pulsing of the energy supply is suitable for attaining a specific plasma effect, such as e.g. generating a specific UV radiation.

Specific supplying of the substances within or outside of the wave-limiting hollow structure results in a selective and controllable modification of these substances. Any undesired reaction of the added substances on the ignition behavior and the ignition structure is prevented by making the addition outside of the wave-limiting hollow structure.

Plasma treatment can also be performed with only atmospheric air under normal pressure. A specific effect can be attained by adding substance mixtures such as e.g. aerosols.

If colored particles (e.g. low-melting polymers) are added to the plasma and transported by a gas flow to the surface to be coated, the particles are melted in the plasma and dissolve into a uniform film upon striking the surface. At the same time the particles are subjected to a plasma treatment that leads to the fact that the layer formed on the surface hardens in a brief period exclusively due to plasma modification of the particles. Thus a further additional treatment (e.g. UV hardening) is not needed.

If the color particles are supplied to the plasma in different shades (e.g. the primary colors), in principle any shade can be attained by adjusting the mixing ratios.

A certain shielding of the plasma from atmospheric influences can be attained using a defined addition of different gases, e.g. the process gas, into the plasma core area and an inert gas as an enveloping and protective gas around the plasma.

The scope of applicability and the performance of the method can be influenced in that a plurality of plasma sources are arranged in series, in an annular manner relative to one another and above one another, or as an array.

One preferred device for performing the method contains the following elements:

a microwave generator for generating microwaves
a microwave line
a microwave feed
a wave-limiting hollow structure
a resonant ignition structure
a supply device for substances A device with these features can be usefully configured in that the microwave line is embodied flexible and substances are supplied to the plasma via a plurality of supply devices.

The invention is explained in the following using exemplary embodiments.

DETAILED DESCRIPTION OF THE INVENTION

Figure 1:
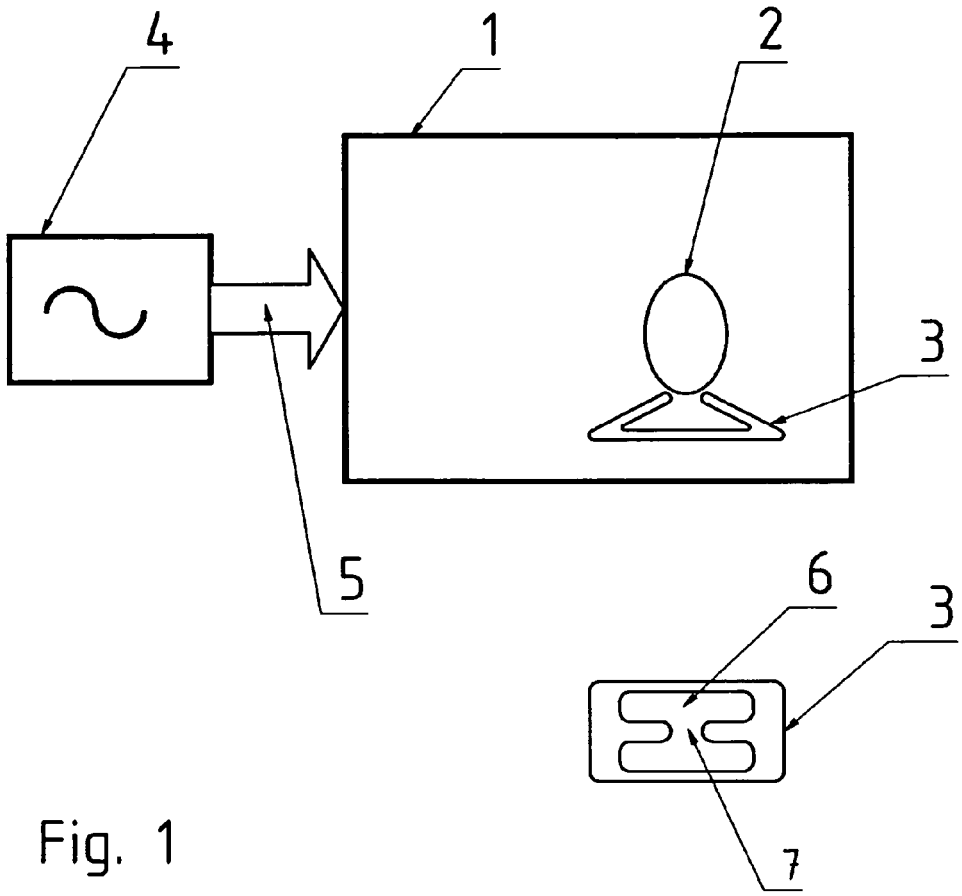
FIG. 1 is a schematic depiction of a basic device for generating an expanding, diffuse microwave plasma.

FIG. 1 is a schematic depiction of the structure of a basic device for implementing the method for igniting and generating an expanding, diffuse microwave plasma within a wave-limiting hollow structure.

The device comprises a wave-limiting hollow structure (1), a resonant ignition structure (3), a microwave generator (4), and a microwave feed (5).

The wave-limiting hollow structure (1) is made of an electrically conducting material such that a hollow chamber results that is dimensioned such that wave propagation is possible within the hollow chamber but is prevented to the outside. Within the wave-limiting hollow structure (1) a resonant ignition structure (3) is arranged such that it can take from an electromagnetic field the energy required for the plasma ignition and the ignited, expanding plasma (2) is supplied with energy from the surrounding electromagnetic field. The resonant ignition structure (3) is formed from two resonance circuits (6) that are electrically coupled to one another such that the open sites of the resonant circuits (6) oppose one another. The resonant length of this resonance circuit (6) is from at least one half wavelength of the frequency used.

The microwaves (2.45 GHz) needed for the structure of an electromagnetic field are generated in a microwave generator (4) and fed via a microwave feed (5) into the wave-limiting hollow structure (1). The plasma (2) is ignited (7) in air under atmospheric conditions and remains within the wave-limiting hollow structure (1). The plasma (2) is supplied via the surrounding microwave field.

Figure 2:
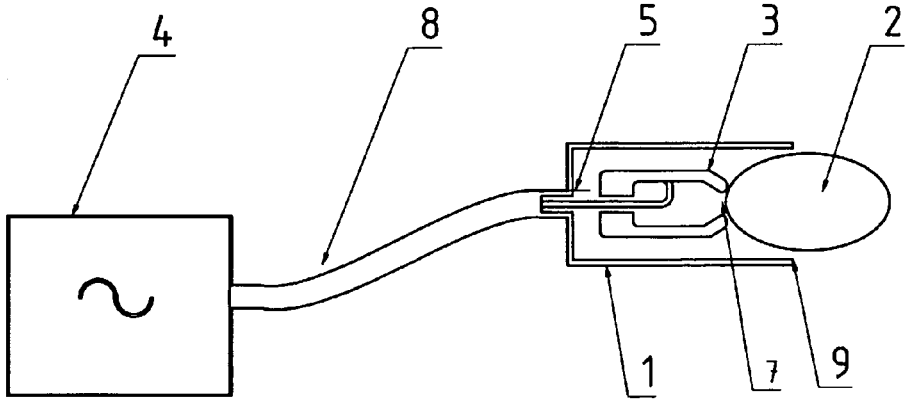
FIG. 2 is a schematic depiction of a special embodiment for generating an expanding, diffuse microwave plasma from a coaxial wave-limiting hollow structure.

FIG. 2 schematically depicts the structure of a special embodiment for generating an expanding, diffuse microwave plasma (2) from a coaxial wave-limiting hollow structure (1).

For many plasma applications, in particular for three-dimensional applications, a freely exiting plasma under atmospheric conditions is of particular significance. Thus the embodiment depicted in FIG. 2 satisfies a major market demand.

The device comprises a wave-limiting hollow structure (1), a resonant ignition structure (3), a microwave generator (4), a flexible microwave line (8), and a microwave feed (5) into the wave-limiting hollow structure (1).

In this case the wave-limiting hollow structure (1) is embodied as a tube with an open end (9). The diameter of the tube is selected corresponding to the wavelength of frequency used (e.g., 2.45 GHz) such that wave propagation is not possible i.e., diameter is less than Lambda/2).

The microwave feed (5) occurs via a flexible microwave line (8) into the wave-limiting hollow structure (1). The resonant ignition structure (3) is embodied in extending the center conductor of the coaxial line such that, firstly, energy is fed directly into the resonant ignition structure (3) for plasma ignition (7), and secondly, with the wave-limiting hollow structure (1) as an outer conductor a coaxial line is formed via which energy is conducted to the end of this coaxial line and thus an electromagnetic field builds up outside of the resonant ignition structure (3). Since the wave-limiting hollow structure (1) is extended beyond the end of the center conductor, it is not possible for waves to propagate beyond the opening (9) into the open. The microwave energy generated by the microwave generator (4) is injected via the flexible microwave line (8) in part into the resonant ignition structure (3) so that plasma ignition (7) occurs at the tip of the resonant ignition structure (3), and is conducted via the coaxial line formed by the resonant ignition structure (3) and the wave-limiting hollow structure (1) to the end of this coaxial line so that the plasma (2) ignited by the resonant ignition structure (3) is supplied with energy via this coaxial line such that the plasma (2) propagates such that an expansion reaches the open.

The plasma (2) is ignited in air under atmospheric conditions and automatically exits from the opening (9).

A plasma diameter and an exit length of several cm can be attained corresponding to the frequency used, 2.45 GHz, and the power fed in.

Figure 3:
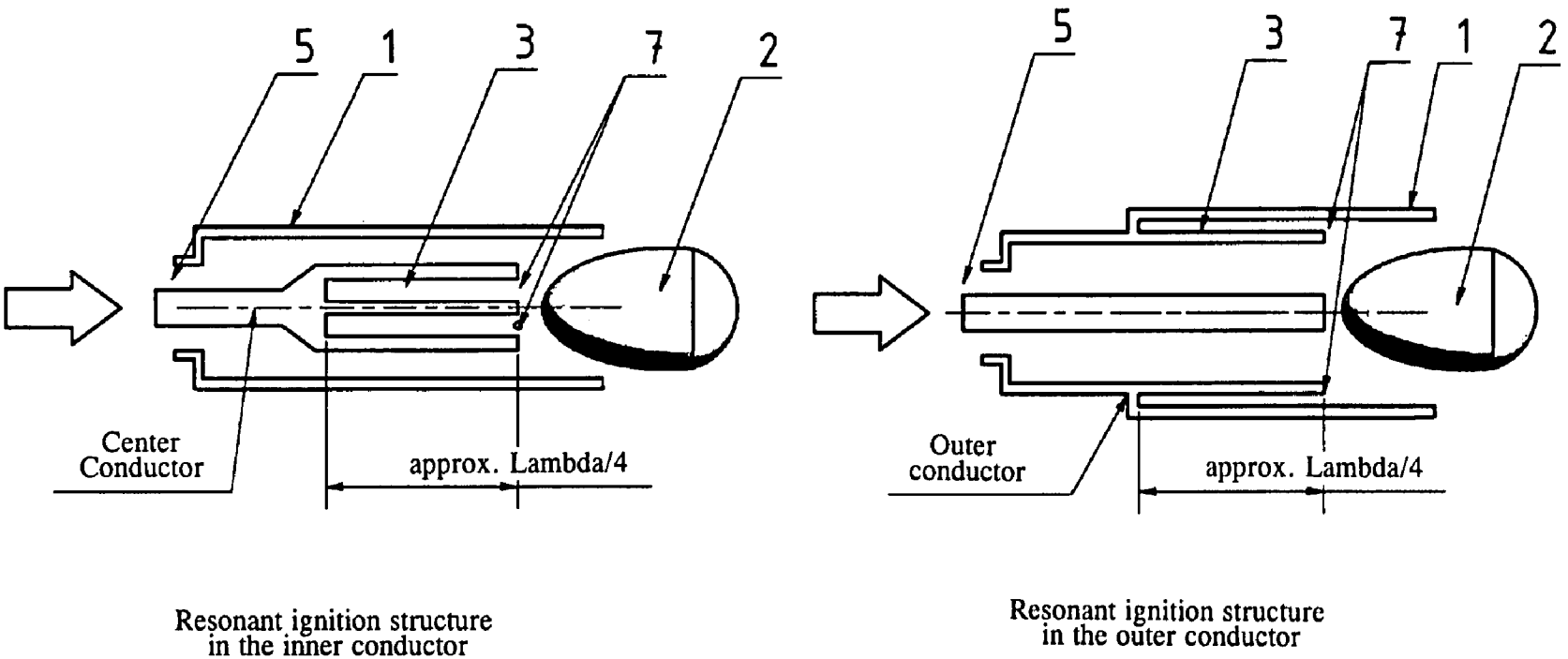
FIG. 3 is a schematic depiction of a special embodiment of the resonant ignition structure as a coaxial structure.

FIG. 3 is a schematic depiction of a particularly advantageous embodiment of the resonant ignition structure. It is provided in that it is embodied as a coaxial structure having a resonant length of Lambda/4 (quarter wavelength) or an uneven multiple of Lambda/4 corresponding to the frequency used. The depth of the resonant structure (3) in this example is approx. Lambda/4.

This resonant structure (3) can be arranged both in the center conductor and in the outer conductor of the coaxial line.

Figure 4:
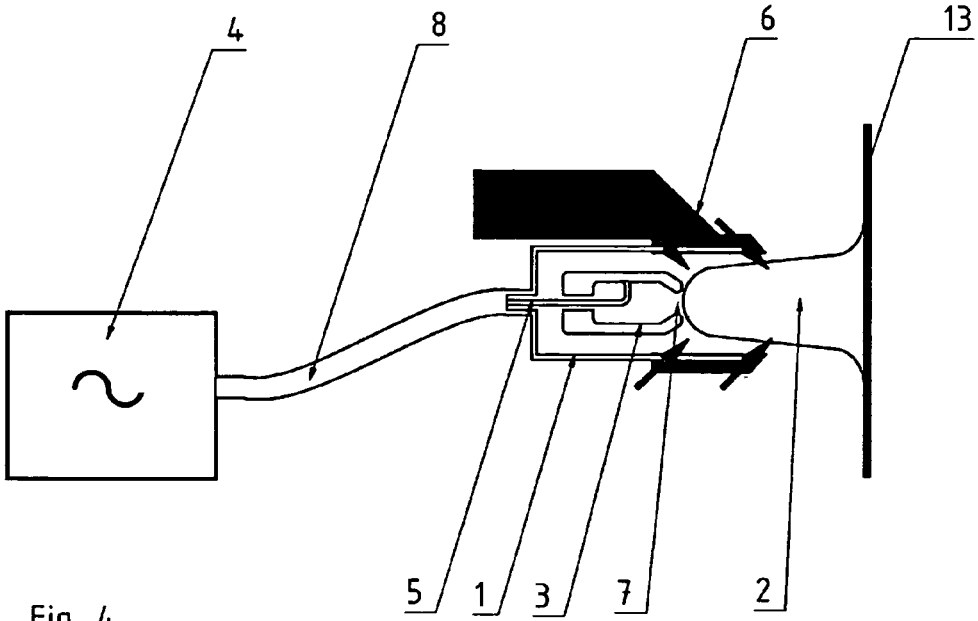
FIG. 4 depicts the basic structure of a plasma treatment device.

FIG. 4 is a schematic depiction of the basic structure of a device for implementing the method for the purpose of plasma treatment of surfaces.

The microwave energy generated by a microwave supply (4) is fed coaxially (5) into the wave-limiting hollow structure (1) via a preferably flexible microwave line (8). The wave-limiting hollow structure (1) is preferably dimensioned as a tube corresponding to the frequency used, 2.45 GHz here, such that wave propagation is only possible in the area of the coaxial structure. Moreover, wave propagation out of the open end of the wave-limiting structure (1) is not possible, however, due to sufficient extension of the wave-limiting structure (1).

The resonant ignition structure (3) is coupled, as an extension of the coaxial feed (5), to the energy supply such that when energy is injected a high ignition field strength results at the tip of the resonant ignition structure (3) that is sufficient for plasma ignition (7), but the ignited plasma (2) is fed via the coaxial line formed from the resonant ignition structure (3) as center conductor and from the wave-limiting hollow structure (1) as outer conductor.

Thus expanding plasma (2) that expands from the opening of the wave-limiting structure (1) occurs as a function of the quantity of energy injected.

A surface (13) to be treated is now arranged in the effective range of the plasma (2) such that a desired treatment effect is obtained, e.g. the surface (13) is activated.

The plasma treatment can be performed with air at atmospheric pressure, without any active gas flow. For active configuration of the plasma treatment, suitable substances can be supplied to the plasma (2), both within and outside of the wave-limiting structure (1), via a special supply device (12) for attaining a defined treatment effect. Further expansion of the plasma (2) is attained by supplying a gas flow. The substances are stored in a container (10) and are supplied to the plasma (2) via the supply device (12). Different substances can be used, depending on the desired application, by exchanging the container (10). Arranging the containers (10) directly at the wave-limiting hollow structure (1) provides the device great flexibility and mobility.

Figure 5:
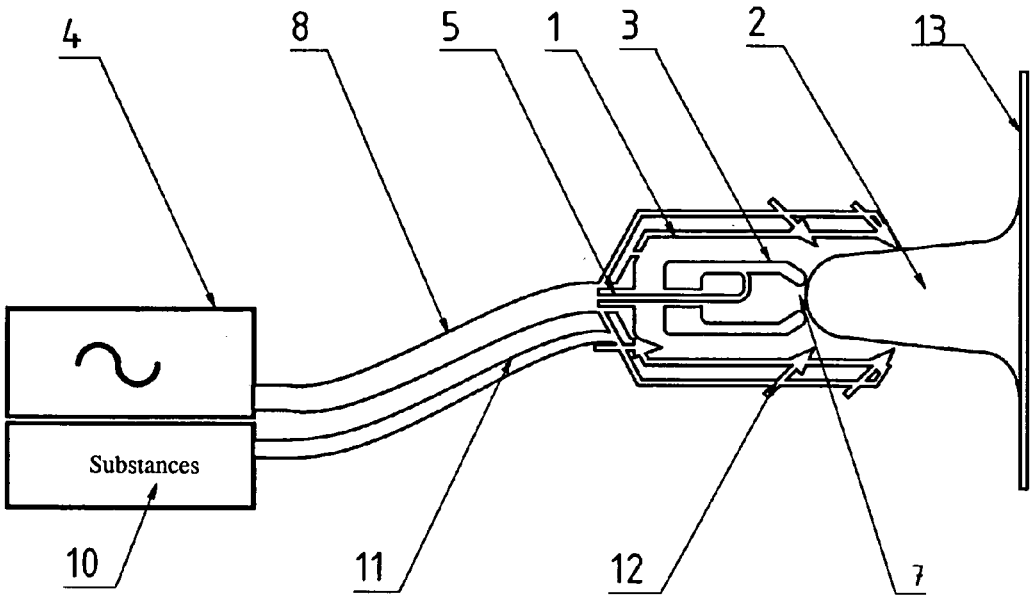
FIG. 5 depicts a plasma treatment device with a flexible substance supply.

FIG. 5 depicts another device, compared to FIG. 4, with which substances provided for plasma treatment are supplied to the plasma (2) via a flexible line (11) from the substance containers (10) via the supply device for substances (12).

Using this embodiment, different substances can be stored in separate containers (10), even in large quantities, and supplied to the plasma (2) as needed. This embodiment is particularly advantageous in stationary systems with high processing capacities and through puts.

The invention claimed is:

1. Method for igniting and generating a microwave plasma by use of an apparatus comprising a microwave-limiting hollow structure containing gas, a microwave generator for supplying microwave energy via a microwave coupling into the microwave-limiting hollow structure, and a resonant ignition structure arranged within the microwave-limiting hollow structure, the method comprising:

supplying microwaves via the microwave coupling into the wave-limiting hollow structure containing gas thereby to form a microwave field which generates a plasma and the resonant ignition structure building a resonance field strength which is sufficiently high for igniting the plasma even when greater power is not supplied, whereby the plasma is ignited and energy is supplied from the microwave field to the plasma so that the plasma is expanded and diffused, and driving of the plasma through the resonant ignition structure does not occur because the supplying to the plasma of energy from the microwave field provides inherent protection of the resonant ignition structure due to autoregulating transition between a plasma ignition phase and a plasma maintenance phase.

2. Method in accordance with claim 1, wherein pressure of the gas is at least atmospheric pressure.

3. Method in accordance with claim 1 or 2, wherein the gas is air or other gas or gas mixture and the gas is or is not made to flow.

4. Method in accordance with claim 3, wherein the plasma is driven by a gas flow.

5. Method for igniting and generating a microwave plasma by use of an apparatus comprising a microwave-limiting hollow structure containing gas, a microwave generator for supplying microwave energy via a microwave coupling into the microwave-limiting hollow structure, and a resonant ignition structure arranged within the microwave-limiting hollow structure, the method comprising:

supplying microwaves via the microwave coupling into the wave-limiting hollow structure containing gas thereby to form a microwave field which generates a plasma and the resonant ignition structure building a resonance field strength which is sufficiently high for igniting the plasma even when greater power is not supplied, whereby the plasma is ignited and energy is supplied from the microwave field to the plasma so that the plasma is expanded and diffused, and driving of the plasma through the resonant ignition structure does not occur because the supplying to the plasma of energy from the microwave field provides inherent protection of the resonant ignition structure due to autoregulating transition between a plasma ignition phase and a plasma maintenance phase, wherein the apparatus further comprises a coaxial line comprising a center conductor and an outer conductor and in the method energy is fed to the resonant ignition structure at an end of the center conductor for the ignition of the plasma and for generating an expanding plasma.

6. Apparatus for igniting and generating a microwave plasma, comprising:

a microwave-limiting hollow structure for containing a gas, a microwave generator in combination with a microwave coupling for conducting microwave energy from the microwave generator into the microwave-limiting hollow structure and a resonant ignition structure arranged within the microwave-limiting hollow structure, whereby microwaves supplied via the microwave coupling into the microwave-limiting hollow structure containing gas generate a plasma and the resonant ignition structure builds a resonance field strength which is sufficiently high for igniting the plasma even when greater power is not supplied, the plasma being ignited and energy being fed from the microwave field to the plasma so that the plasma expands and diffuses, and driving of the plasma through the resonant ignition structure not occurring because the supplying to the plasma of energy from the microwave field provides inherent protection of the ignition device due to autoregulating transition between a plasma ignition phase and a plasma maintenance phase.

7. An apparatus for igniting and generating an expanding diffuse plasma within a coaxial hollow structure, comprising:

a microwave-limiting hollow structure for containing a gas:

a microwave generator in combination with a microwave coupling for conducting microwave energy from the microwave generator into the microwave-limiting hollow structure;

a resonant ignition structure, arranged within the microwave-limiting hollow structure; and a coaxial line having an outer conductor and a center conductor, the outer conductor being formed by the microwave-limiting hollow structure, the resonant ignition structure forming an extension of the center conductor;

wherein injection of microwaves at the ignition structure leads to ignition of the plasma, the plasma being supplied with energy via the coaxial line; and wherein plasma exits an open end of the coaxial outer conductor beyond the center conductor, and a diameter of the coaxial outer conductor corresponds to a frequency at which wave propagation does not occur beyond said open end.

8. Apparatus for igniting and generating a microwave plasma, comprising:

a microwave-limiting hollow structure for containing a gas, a microwave generator in combination with a microwave coupling for conducting microwave energy from the microwave generator into the microwave-limiting hollow structure and a resonant ignition structure arranged within the microwave-limiting hollow structure, whereby microwaves supplied via the microwave coupling into the microwave-limiting hollow structure containing gas generate a plasma and the resonant ignition structure builds a resonance field strength which is sufficiently high for igniting the plasma even when greater power is not supplied, the plasma being ignited and energy being fed from the microwave field to the plasma so that the plasma expands and diffuses, and driving of the plasma through the resonant ignition structure not occurring because the supplying to the plasma of energy from the microwave field provides inherent protection of the ignition device due to autoregulating transition between a plasma ignition phase and a plasma maintenance phase, and further comprising a coaxial line, the resonant ignition structure comprising an inner conductor or an outer conductor of the coaxial line and the coaxial line having a length corresponding to one-half or an uneven multiple of one-half of a wavelength corresponding to frequency at which the microwave generator is to be operated.

9. A method for plasma treating a surface by use of an apparatus comprising a microwave generator, a coaxial hollow structure comprising a microwave-limiting hollow structure containing a gas from which a plasma is to generated, a resonant ignition structure coaxially arranged in the hollow structure, and a microwave coupling for conducting microwave energy from the microwave generator into the microwave-limiting hollow structure, the microwave-limiting hollow structure having an opening for exiting of the plasma, comprising:

supplying microwaves via the microwave coupling into the microwave-limiting hollow structure containing said gas thereby to form a microwave field which generates a plasma and the resonant ignition structure building a resonance field strength which is sufficiently high for igniting the plasma even when greater power is not supplied, whereby the plasma is ignited and energy is fed from the magnetic field to the plasma so that the plasma is expanded and diffused, and driving of the plasma through the resonant ignition structure does not occur because the supplying to the plasma of energy from the microwave field provides inherent protection of the ignition device due to autoregulating transition between a plasma ignition phase and a plasma maintenance phase, and arranging a surface to be plasma treated adjacent the opening whereby the plasma propagating beyond the opening treats the surface.

10. The method in accordance with claim 9, further comprising supplying to the plasma in the microwave-limiting hollow structure an additional substance for treating the surface, the additional substance comprising a particulate solid, a liquid or a gas.

11. A method for plasma treating a surface by use of an apparatus comprising a microwave generator, a coaxial hollow structure comprising a microwave-limiting hollow structure containing a gas from which a plasma is to generated, a resonant ignition structure coaxially arranged in the hollow structure, and a microwave coupling for conducting microwave energy from the microwave generator into the microwave-limiting hollow structure, the microwave-limiting hollow structure having an opening for exiting of the plasma, comprising:

supplying microwaves via the microwave coupling into the microwave-limiting hollow structure containing said gas thereby to form a microwave field which generates a plasma and the resonant ignition structure building a resonance field strength which is sufficiently high for igniting the plasma even when greater power is not supplied, whereby the plasma is ignited and energy is fed from the magnetic field to the plasma so that the plasma is expanded and diffused, and driving of the plasma through the resonant ignition structure does not occur because the supplying to the plasma of energy from the microwave field provides inherent protection of the ignition device due to autoregulating transition between a plasma ignition phase and a plasma maintenance phase;

arranging a surface to be plasma treated adjacent the opening whereby the plasma propagating beyond the opening treats the surface;

supplying to the plasma in the microwave-limiting hollow structure an additional substance for treating the surface, the additional substance comprising a particulate solid, a liquid or a gas; and wherein the substance comprises colored particles and upon impinging on the surface being treated by the plasma the particles form a homogenous layer on said surface, the layer hardening in a brief period due to plasma modification of the particles.

12. Method in accordance with claim 11, wherein the colored particles are of different colors and are mixed in a predetermined ratio.

13. An apparatus for plasma treating a surface, comprising:

a microwave generator, a coaxial hollow structure comprising a microwave-limiting hollow structure for containing a gas from which a plasma is to be generated, a resonant ignition structure coaxially arranged in the hollow structure, and a microwave coupling for conducting microwave energy from the microwave generator into the microwave-limiting hollow structure, the microwave-limiting hollow structure having an opening for propagation of the plasma there-beyond for impingement upon a surface to be treated which faces the opening.

14. An apparatus for igniting and generating a microwave plasma, comprising:

a microwave-limiting hollow structure for containing a gas;

a microwave generator in combination with a microwave coupling for conducting microwave energy from the microwave generator into the microwave-limiting hollow structure; and a resonant ignition structure arranged within the microwave-limiting hollow structure;

wherein microwaves supplied via the microwave coupling into the microwave-limiting hollow structure containing gas generate a plasma;

wherein the resonant ignition structure builds a resonance field strength which is sufficiently high for igniting the plasma even when greater power is not supplied, the plasma being ignited and energy being fed from the microwave field to the plasma so that the plasma expands and diffuses;

wherein driving of the plasma through the resonant ignition structure not occurring because the supplying to the plasma of energy from the microwave field provides inherent protection of the ignition device due to auto-regulating transition between a plasma ignition phase and a plasma maintenance phase; and wherein the resonant ignition structure is embodied as a coaxial line structure comprising a center conductor and an outer conductor, and has one open end with a length corresponding to one-quarter or an uneven multiple of one-quarter of a wavelength corresponding to a frequency at which the microwave generator is to be operated.

15. The apparatus of claim 14, in which the resonant ignition structure comprises:

a first and a second resonant circuit, each of which has an open site, the first and second resonant circuits being electrically coupled together with the open site of the first resonant circuit being in opposition to the open circuit of the second resonant circuit; and wherein pressure of the gas ignited into the plasma is at least atmospheric pressure.

* * * * *